US008523714B2

(12) United States Patent
Thackeray

(10) Patent No.: US 8,523,714 B2
(45) Date of Patent: Sep. 3, 2013

(54) SWING TRAINING AND FITNESS AID

(76) Inventor: Tracy Thackeray, Napa, CA (US)

( * ) Notice: Subject to any disclaimer, the term of this patent is extended or adjusted under 35 U.S.C. 154(b) by 0 days.

(21) Appl. No.: 13/134,626

(22) Filed: Jun. 11, 2011

(65) Prior Publication Data

US 2012/0316012 A1 Dec. 13, 2012

(51) Int. Cl.
*A63B 69/00* (2006.01)
*A63B 59/00* (2006.01)

(52) U.S. Cl.
USPC ..... 473/457; 473/422; 473/437; 473/564

(58) Field of Classification Search
USPC ..... 473/422, 424, 457, 437, 138, 219, 473/231; D21/725; 482/109
See application file for complete search history.

(56) References Cited

U.S. PATENT DOCUMENTS

| | | | | | |
|---|---|---|---|---|---|
| 1,549,790 | A * | 8/1925 | Neusella | D21/725 |
| 1,930,342 | A * | 10/1933 | Graham | 473/232 |
| 2,765,170 | A * | 10/1956 | Brown | 473/424 |
| 3,039,228 | A * | 6/1962 | Mazzadra | D21/455 |
| 3,874,660 | A * | 4/1975 | Brethen | 482/109 |
| 4,249,762 | A * | 2/1981 | Richards | 473/256 |
| 4,415,155 | A * | 11/1983 | Goudreau et al. | 473/424 |
| 4,664,388 | A * | 5/1987 | Huber | 473/138 |
| 5,056,785 | A * | 10/1991 | Robey | 473/459 |
| 5,599,021 | A * | 2/1997 | Lary et al. | 473/219 |
| 7,775,911 | B2 * | 8/2010 | Zappel et al. | 473/422 |

* cited by examiner

*Primary Examiner* — Mitra Aryanpour
(74) *Attorney, Agent, or Firm* — Gerald L. Robertson, Esq.

(57) ABSTRACT

A swing training and fitness aid comprising a handle having an extended portion of rotational configuration engaged with a rotating means having flexibly affixed thereto a weight, the weight capable of being rotated along the extended portion in two directions by rotating said handle portion, thereby strengthening the wrists, forearms and shoulders of the user, along with exercising the abdominal muscles and the large muscle groups of the legs.

6 Claims, 3 Drawing Sheets

SWING TRAINING AND FITNESS AID

FIELD OF THE INVENTION

The invention pertains to the field of training aids, primarily training aids which help athletes who wish to improve their ability and strength in swinging a bat or a club.

REFERENCE TO RELATED APPLICATIONS

This application is an original first filing; no provisional, continuation or other document has been filed with the United States Patent & Trademark Office by applicant pertaining to this subject matter.

ACKNOWLEDGMENT OF GOVERNMENT SUPPORT

This invention was not developed with any type of government support. The government has no rights in applicant's invention.

BACKGROUND OF THE INVENTION

The science of sports has in recent decades expanded to assist athletes with knowledge, guidance and training in numerous areas; including but not limited to nutrition, physical fitness, aerodynamics, muscle development, sports psychology and more.

In sports like baseball, golf and tennis, the subject of swing dynamics is heavily researched with the result that athletes are being educated more and more how to position and rotate their bodies to impart the greatest amount of force as well as swing speed to swing a club or bat to hit a ball farther and farther. Along with body position, swing exercises are taught young athletes to develop good swing characteristics as early as possible.

In addition, training aids have become popular in order to position arm and shoulder movement and to strengthen the arms, hands and wrists. For example, the MEDICUS® golf club is a training aid which has a break-away in the shaft near the club head. That break-away is designed to break when the swing arc is out of the desired swing arc area with the misdirected force causing the club to "fold." When the swing characteristics are correct, the club remains configured as a typical club, and allows the user to swing through to hit a golf ball without the breaking down of the club.

In another example, the recent marketing of the shaker weight for women shows a dumbbell shaped weight with an inner portion of the weight movable along the axis of the weight handle, captured therein, providing a reciprocating or dynamic component to the action of the weight, further challenging not only the traditional muscles exercised by a simple dumbbell, but other associated muscles which are affected by the dynamic motion.

In the sport of baseball, many tests have shown that rotational mechanics are far more efficient than linear mechanics in developing bat speed. In order to understand why this is true, it is important to understand the forces acting on the bat.

Other than the effects of gravity, drag and other minor factors, there are two forces acting on the bat that create bat speed; Circular Hand Path (CHP)—The transfer of the body's rotational momentum that occurs when the hands are taken in a circular path; and Torque—Torque is applied at the handle of the bat by the push/pull of the hands/arms/shoulders.

In considering Circular Hand Path, the bat will undergo angular displacement (i.e., bat speed) when the path of the hands is also undergoing angular displacement (i.e., a circular hand path). In other words, as long as the path of the hands stays in a circular path as the body rotates, the circular hand path will transfer the body's rotational momentum into bat-head acceleration.

CHP is often referred to as the "Pendulum Effect" so as to distinguish it from the "Crack of the Whip" theory. A pendulum is simply an object that swings freely back and forth in a circular arc. But, in the baseball swing, there are two pendulums at work at the same time: 1) the lead-arm swings the hands in a circular arc, and 2) the end of the bat swings around the hands. This is referred to as the Double Pendulum Effect of a CHP. A double pendulum consists of one pendulum attached to another.

Linear mechanics is much different in that it does not rely on a circular arc or Pendulum Effect, as it is based on a theory that when the hands are extended in a straight line, the bat-head will suddenly accelerate to contact like the crack of a whip ("Crack of the Whip theory".) However, this theory is flawed since there is no whip effect in the baseball swing (a bat is not flexible like a whip), and consequently, efforts to produce a whip effect have stalled many hitters progress for decades. This is far different from the sport of golf, where the golf club shaft varies in degrees of stiffness, depending on the ability of the golfer to generate clubhead speed. The higher the clubhead speed, the stiffer the golf club shaft employed.

A substantial portion of a good hitter's bat speed is derived from the circular path of his hands (think of swinging a weight on the end of a string). As long as the hands are maintained in a circular path, the weight will continue to accelerate in a circle. However, if the path of the hand straightens, the weight on the end of the string loses angular velocity and trails behind the hands.

The same rational applies when a hitter is swinging a bat. If the hands are kept in a circular path, the bat will continue to accelerate. But if the hands straighten, the batter loses the circular path and the bat will lose speed. With a straighter hand path, the bat-head trails behind the hands well into the swing. This is often referred to as "knob of the bat first" and results in poor bat speed.

In considering the effect of Torque specifically upon the swing, Torque is the result of two forces being applied to an object from opposing directions that cause the object to rotate about a point. Forces in the same direction may cause the object to accelerate, but will not cause the object to rotate about a point (which therefore means no angular displacement). For example, when loosening a lug nut with a 4-prong tire wrench, you push down with one hand while pulling up with the other (torque). However, if you push down (or pull up) with both hands, you would not cause the nut to rotate; i.e., no torque results.

Torque is applied in the swing by the concurrent push and pull action of the forearms and hands. The bat head is accelerated from torque when the direction of force applied by the hands is from opposing directions.

To reach maximum bat speed, the batter must apply torque from initiation to contact and keep the hands in a circular path.

Average hitters usually have little circular hand path in their swing (no pendulum effect) due to the straighter hand path. As a result, average hitters rely mainly on torque to accelerate the bat hitting area.

For a batter to attain his maximum potential, his mechanics must make efficient use of both CHP and Torque. Great hitters generate high bat speed because their swing mechanics efficiently apply torque at the handle that compliments their circular hand path.

Most batting instructors would agree that there is a correlation between the velocity of the bat and how far a hit ball will travel. But, two players swinging the same bat on about the same plane with comparable bat speeds may vary greatly in the power they display. One might hit balls significantly farther than the other. This would seem to be contradictory unless one takes into account when the maximum bat speed occurred during the two swings.

The bat speed that really counts is that attained at impact with the ball. Swing mechanics of a great hitter allows the generation of higher bat speed much earlier in the swing compared with average hitters. Players with a lot of "pop" in their bat expend all the body's rotational and torque energies before and at impact. After impact, the batter's limbs and torso reach a relaxed and coast mode. The follow through portion of the swing is from the momentum of the bat pulling the arms up and through Some hitters continue to expend energy to gain bat speed for anywhere from 20 to 40 degrees (average hitters) to as much as 60 degrees and beyond (poor hitters) of bat travel after the bat passes the contact point. Some coaches would contend that gaining speed after contact is beneficial because of the "driving through the ball" effect. The facts do not support this theory. The ball is in contact with a 35 oz. wood bat moving at perhaps 70 MPH for about 1/2000 of a second. During this time the bat moves less than 1 in. (about 3/4 in.) This phenomenon does not provide much opportunity for "driving through" the ball.

Wrists play an important role in producing power and quickness for both the baseball and golf swings. But the muscle groups that flex and un-flex (abduct and adduct) the wrist are a relatively small muscle group and have a limited impact on the generation of bat speed.

For a ball to be hit over 400 feet, the bat head must be accelerated to a speed in excess of 70 MPH in less than 5/30 of a second. About half that speed is developed in the last 1/30 of a second. The large amount of inertia that must be overcome to accelerate the bat head 35 MPH or more in 1/30 of a second requires far more energy than the muscles in the hands, wrists and arms can produce. That kind of energy (about 3 torque HP) must come from the large muscle groups in the legs, back and shoulders.

The question then becomes; how is the energy transferred from the large muscle groups of the body up and on out to the bat head? The large muscles in the legs and back must rotate the hips and shoulders to a point where the abdomen and chest face the pitcher. The lead shoulder must rotate back in the direction of the catcher. This means that the lead arm, and thus the bottom hand, are now being pulling back toward the catcher as the bat approaches contact at the same time the rear shoulder and top hand are rotating around toward the pitcher.

This generates a tremendous amount of TORQUE on the bat. As stated, Torque is the result of forces being applied to the bat from opposing directions that causes it to rotate about a point between the hands.

So, in the swing of a great hitter, what appears to be wrist action is actually the "push-pull" action of the hands generating a large amount of torque. This torque was developed from the large muscle groups and causes the bat head to be greatly accelerated.—If the batter does not initiate the swing with torque and rotational forces, he will not be able to obtain the position of power required to apply maximum torque to the bat before contact. This is especially true for pitches on the outside part of the plate.

Consequently, it is important for the batter to not only develop the large muscle groups to allow the appropriate rotation of the body during the swing, but to also develop the arms and wrists to generate the circular motion required to maximize the torque which can be applied by the push and pull of the hands, thereby having the hands move in a circular motion relative to the end of the bat as well as to crack the whip and produce the maximum pop of the swing.

Just swinging the bat repetitiously does have an effect on the strengthening of the muscles, but sometimes, too much repetition can also fatigue the player. In addition, it is simply not practical to strengthen the wrists, forearms and torso by swinging a bat when in a gymnasium setting or at home or in crowded areas or confined spaces.

What is needed is a focused training aid which can be used by an athlete hoping to strengthen the necessary wrist, forearm and shoulder muscles without the need to swing a 35 oz. bat about when doing so might be dangerous.

Furthermore, simply swinging the bat does not necessarily focus the strengthening of the wrist muscles, or provide the torque challenge to the athlete in and of itself. What is needed then is a training aid which applies forces to the user which naturally strengthen the wrist, forearm and shoulder muscles, keying on the muscles necessary to improve the torque of the swing by the ability to more easily rotate the hands in a circular motion at the same time the bat is swung.

SUMMARY OF THE INVENTION

Applicant has devised a swing training and fitness aid allowing the athlete to strengthen the wrist, forearm and shoulder muscles to increase the amount of torque or push and pull of the hands applied when swinging a bat or club.

By adapting a bat handle to accept a length of rod which has been provided with a threaded surface or other rotational provision to allow the swinging of a weight about the longitudinal axis of said rod, Applicant provides for the athlete to move the bat handle in a circular motion, the rotation of the weight toward the other end of the device forcing the athlete to use just those muscle groups which are flexed in the aforementioned push and pull motion. By practicing with Applicant's device, these muscles strengthen with practice.

A further advantage of Applicant's device is that by standing with the feet approximately shoulder width apart or a little wider and extending the forearms in front of the body in order to apply the circular motion with the training device, it is unnecessary to make a swinging motion with the "bat." This allows the athlete to train in a smaller space with little danger to those in close proximity.

An additional benefit to Applicant's invention is that at the same time the athlete is strengthening his forearms, muscles and shoulders, with the weight traveling in a circular motion as it does, the athlete is forced to keep his abdominal muscles tight as well as the quads and hamstrings, thereby further strengthening the large muscle groups whose rotation is key to increasing bat swing speed.

In one embodiment of Applicant's invention, the rotating attachment employed to secure the weight to the extended portion of the handle is offset such that the weight swings in a plane about the extended portion a predetermined distance from the plane which the attachment rotates about the extended portion. By providing this offset, a component of force of the rotating weight is directed along the axis of the extended portion, allowing the weight to travel up or down the extended portion of the bat depending on which direction the bat is rotated; e.g., clockwise or counter-clockwise. This provision enables the wrists to be strengthened in both directions of circular rotation, and as well, suits right or left-handed batters.

In yet another embodiment of Applicant's invention, provisions to removably install a first axle at the tip of the device as well as a second axle at the end of the handle portion of the device, said axles each retaining a bushing substantially axially fixed thereon, each bushing having an attachment means for attaching a weight of predetermined size and density such that the device may be used by holding the device with hands apart and rotating the device in order to strengthen the wrists separate from the normal grip used when batting and swinging.

DETAILED DESCRIPTION OF THE INVENTION

Figure 1:
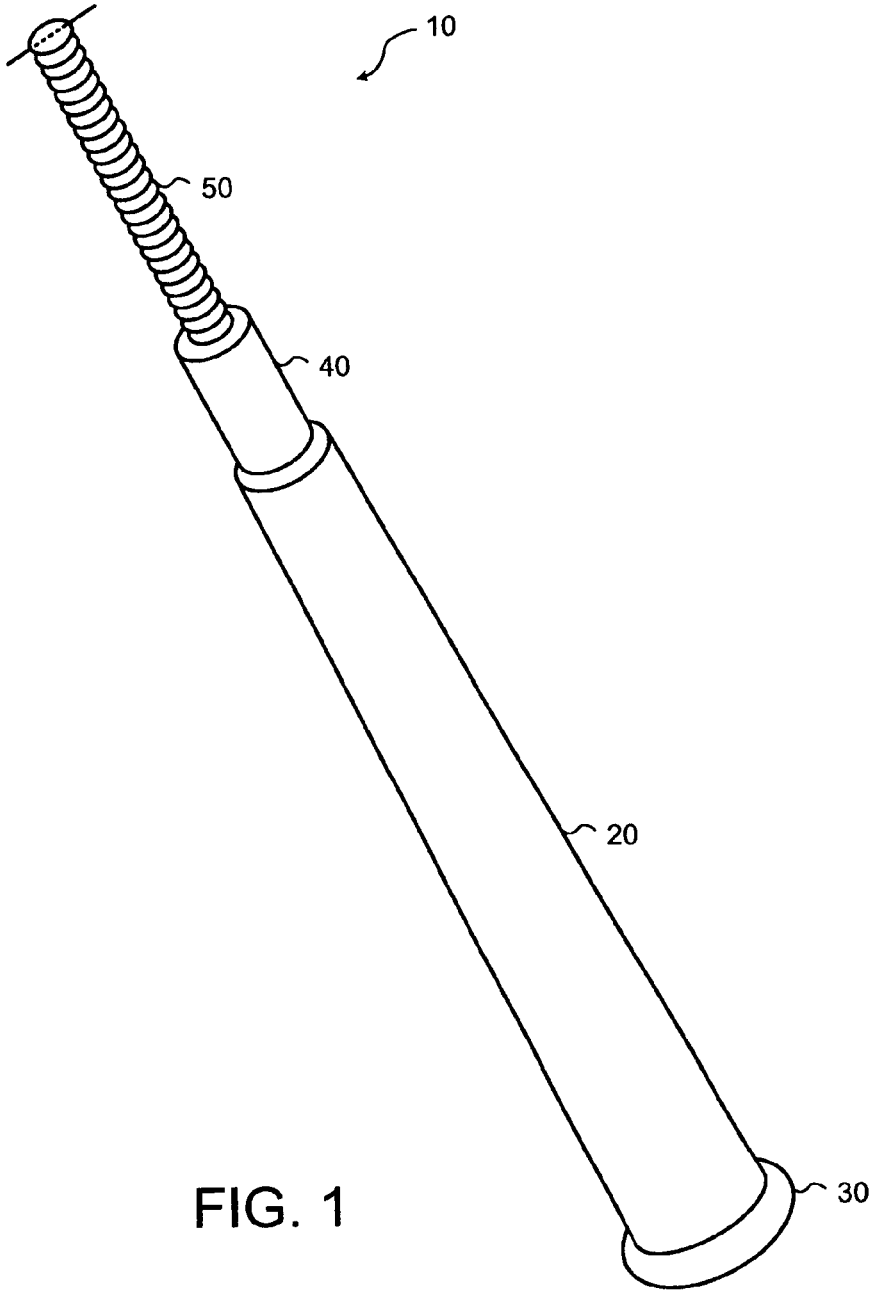
FIG. 1 is an isometric view of the handle of Applicant's invention and a portion of the extended rod with rotational configuration.

FIG. 1 is an isometric view of Applicant's swing training and fitness aid, 10, comprising a bat handle, 20 with butt end 30, transition piece, 40 and extended portion 50. Said butted handle may be in the form of a standard baseball bat handle although any similar configuration comfortable for the athlete may be employed. Transition piece 40 provides an area for attachment of extended portion 50 into handle 20. Extended portion 50 may be a piece of all thread, hollow or solid, or any other cylindrical portion providing a rotatable means. If allthread is used, it may be threaded into a female threaded portion of either the transition piece or said handle 20 itself. Multiple attachment means may be used to affix (removably or not) said extended portion 50 to said handle. A typical means would be threadably engaging said extended portion 50 into a mating female threaded portion (not shown) in said transition piece 40 and secured with a set screw (not shown). Further, it is anticipated that said extended portion may have said handle molded around a portion of it to so affix said portion to said handle, or in the case of allthread, allthread couplings may be integral to the pre-molded handle in order to accept said extended portion. As stated, other affixing means may be employed but are not the essence of applicant's invention.

In another embodiment (not shown), the transition piece is not employed, the extended portion being affixed simply to the end of the handle or removably attached. In other embodiments (not shown), the equivalent of the transition piece is simply pre-molded into said handle.

Figure 2:
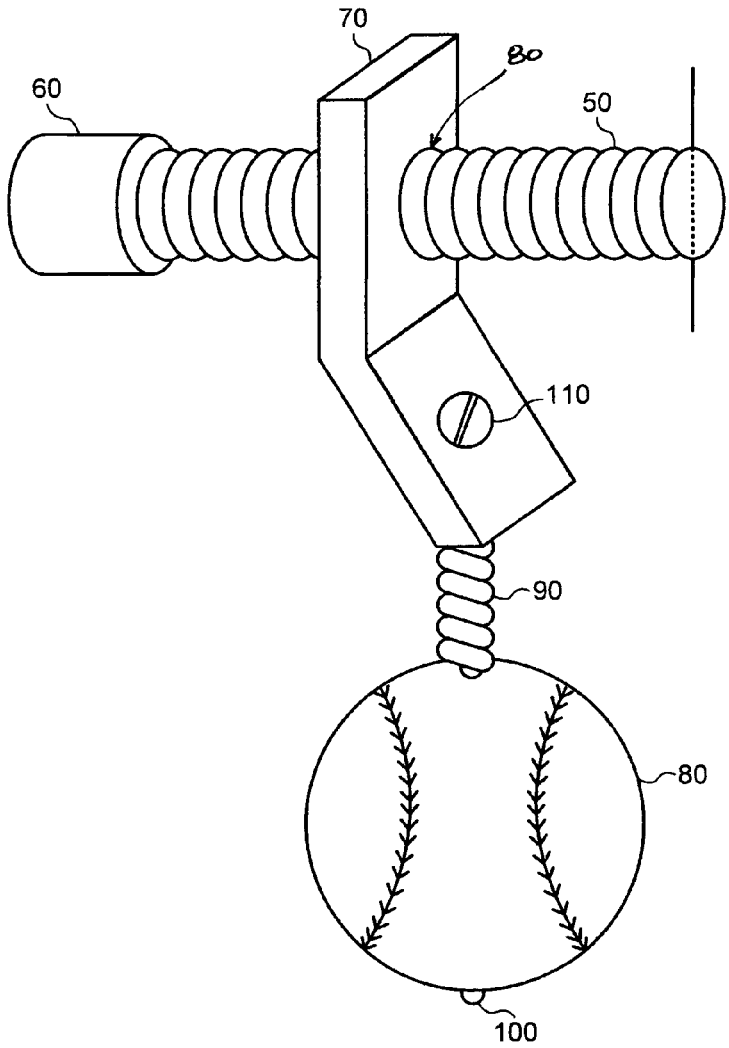
FIG. 2 is an isometric view of that distal portion of the extended rod showing an rotational means for a weight.

FIG. 2 is an isometric view of the distal end of extended portion 50, an end cap 60, rotational attachment 70, having extended therefrom, a weight 80, in this case, a baseball. Any other suitable weight may be substituted therefor. Weight 80 is removably attached to said rotational means via a spring, 90. A spring is utilized in the preferred embodiment of Applicant's invention. Other suitable flexible and extendable means may be used in place of spring 90, such as bungee cord, or similar material. Spring 90 is removably attached to weight 80. In this embodiment, said spring 90 has an elongated end which extends through said weight 80 and is terminated by a fastening means 100 which may comprise a variety of fastening means including a cotter pin extending through a hole in said elongated end (not shown) or others. The other end of said spring 90 is removably affixed to said rotational attachment by a spring retaining means. As in the opposite end of said spring and its attachment means, a variety of fastening means may be employed to affix said spring 90 to said rotational attachment 70. In the preferred embodiment, said spring 90 is hooked to at least one hole provided in said attachment 70.

Figure 3:
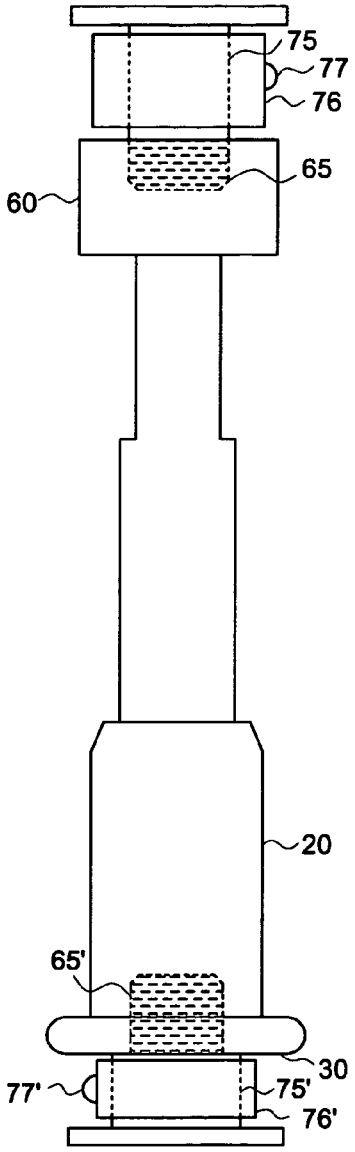
FIG. 3 depicts that embodiment of Applicant's invention employing two rotating weights.

In FIG. 2, end cap 60 is affixed to said extended portion 50. Said cap 60 provides an end stop for said rotational attachment 70. In the embodiment wherein weights are provided at the butt 30 of said handle 20 as shown in FIG. 3 as well as in cap 60, said butt 30 and said cap 60 are provided with, for example, threaded receptacles (not shown) 65 and 65' in which two axles 75 and 75' with retained rotating bushings 76 and 76' having weight attachment means 77 and 77' may be mounted. In such a configuration, no rotational attachment or threading of the extended portion is necessary.

In another embodiment of applicant's invention, the end cap is unnecessary as the extended portion may be configured to accept the threaded receptacle.

As shown in FIG. 2, rotational attachment 70 is angled or provided with an offset portion such that when it rotates about extended portion 50, the rotational plane of said weight is different from said plane in which said rotational attachment rotates. This offset between rotational planes allows said weight to more easily travel along said extended portion 50, depending on the rotational motion applied by the user, and the direction of the threads or other rotational provision thereon. In order to travel along said extended portion 50, as seen in FIG. 2, said rotational attachment has provided therein a through bore, 80, which threadably engages said extended portion 50. Directing applicant's device either up or down while rotating further facilitates the travel of said rotational attachment 70 and weight 80 in either direction.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A swing training and fitness aid comprising:

a handle;

an extended portion, said portion affixed to said handle in substantial alignment therewith;

a rotational attachment engaged with said extended portion such that said rotational attachment may rotate around said portion in primary planar fashion at the point of engagement, said rotational attachment further comprising an offset, said offset having a plane of rotation around said extended portion a predetermined distance from said primary plane of rotation of said rotational attachment;

a spring, said spring having affixed at one end a weight, means for fastening said spring's unattached end to said offset; and an end cap, affixed to said extended portion at the end opposite said handle.

2. The invention of claim 1 wherein:

said handle having a butt end opposite said extended end.

3. The invention of claim 1 wherein:

said extended portion having a substantially threaded circumference, said rotational attachment having a substantially threaded through bore sized to threadably engage circumference of said extended portion.

4. A swing training and fitness aid comprising:

a handle;

a transition piece at one end of said handle;

an extended portion, said extended portion affixed to said transition piece in substantial alignment with said handle;

a rotational attachment engaged with said extended portion such that said rotational attachment may rotate around said portion in primary planar fashion at the point of engagement, said rotational attachment further comprising an offset, said offset having a plane of rotation around said extended portion a predetermined distance from said primary plane of rotation of said rotational attachment;

a spring, said spring having affixed at one end a weight;

means for fastening said spring's unattached end to said offset; and an end cap, affixed to said extended portion at the end opposite said handle.

5. The invention of claim 4 wherein:

said transition piece comprises an allthread coupling molded into the end of said handle.

6. A swing training and fitness aid composing:

a handle, said handle having a first threaded receptacle in one end and a transition piece affixed to said handle's opposite end;

an extended portion affixed to said transition piece in substantial alignment with said handle;

an end cap, affixed to said extended portion at the end opposite said handle, said end cap having a second threaded receptacle therein;

a first axle having a threaded portion at one end, said first axle's threaded portion engaged in said first threaded receptacle;

a second axle having a threaded portion at one end, said second axle's threaded portion engaged in said second threaded receptacle;

a first bushing having an inside diameter sized to rotate about said first axle, said first bushing having means for attaching a weight on said first bushing's outer circumference;

means for retaining said first bushing on said first axle;

said first bushing's length sized such that when said first axle is inserted through said first bushing and said first axle's threaded portion is engaged with said threaded receptacle of said end cap, said means for retaining said first bushing on said first axle locates said first bushing proximate to said handle;

a second bushing having an inside diameter sized to rotate about said second axle, said second bushing having means for attaching a weight on said second bushing's outer circumference;

means for retaining said second bushing on said second axle;

said second bushing's length sized such that when said second axle is inserted through said second bushing and said second axle's threaded portion is engaged with said threaded receptacle of said end cap, said means for retaining said first bushing on said first axle locates said first bushing proximate to said end cap;

a first weight removably affixed to said first bushing's outer circumference; and a second weight removably affixed to said second bushing's outer circumference.

* * * * *